US009434592B2

(12) United States Patent
Niehr

(10) Patent No.: US 9,434,592 B2
(45) Date of Patent: Sep. 6, 2016

(54) DEVICE FOR ASEPTIC OR STERILE TREATMENT OF PACKAGING ELEMENTS

(75) Inventor: Thomas Niehr, Erkelenz (DE)

(73) Assignee: KHS GmbH, Dortmund (DE)

( * ) Notice: Subject to any disclaimer, the term of this patent is extended or adjusted under 35 U.S.C. 154(b) by 1191 days.

(21) Appl. No.: 13/497,860

(22) PCT Filed: Sep. 7, 2010

(86) PCT No.: PCT/EP2010/005475

§ 371 (c)(1),
(2), (4) Date: Mar. 23, 2012

(87) PCT Pub. No.: WO2011/063866

PCT Pub. Date: Jun. 3, 2011

(65) Prior Publication Data

US 2012/0180429 A1 Jul. 19, 2012

(30) Foreign Application Priority Data

Nov. 24, 2009 (DE) ..... 10 2009 054 314

(51) Int. Cl.
*B65B 1/00* (2006.01)
*B65B 3/00* (2006.01)
(Continued)

(52) U.S. Cl.
CPC ..... *B67C 3/22* (2013.01); *B65B 31/022* (2013.01); *B65B 2210/06* (2013.01); *B67B 3/02* (2013.01); *B67B 3/2033* (2013.01);
(Continued)

(58) Field of Classification Search
CPC ..... B67C 2003/2694; B67C 7/0086; B67C 2201/08; B67C 3/02; B67C 3/2033; B67C 2003/2691; B65B 31/022
USPC ..... 53/266.1, 267, 272, 275, 276, 277, 278, 53/285, 167
See application file for complete search history.

(56) References Cited

U.S. PATENT DOCUMENTS 5,417,031 A * 5/1995 Bankuty ..... B65B 7/2835 53/331.5
5,848,515 A * 12/1998 Catelli ..... B65B 55/02 141/147

(Continued)

FOREIGN PATENT DOCUMENTS

DE 29713155 9/1998
DE 29713155 U1 * 9/1998

(Continued)

*Primary Examiner* — Gloria R Weeks
*Assistant Examiner* — Eyamindae Jallow
(74) *Attorney, Agent, or Firm* — Occhiuti & Rohlicek LLP

(57) ABSTRACT

An apparatus for treating a packaging element having a sub-area that includes a packaging-element opening includes an enclosure having an outer load-bearing structure having load-bearing elements and a wall structure held in the load-bearing structure and isolated by the load-bearing structure from loads. It also has two subsections, one on and moving with a conveyor and the other on a device frame and not moving with the conveyor. The enclosure defines a sterile interior that contains the packaging-element opening. The conveyor moves the packaging element along a transport route in a transport direction. Supports of the load-bearing structure extend transversely to the transport direction and connect to a longitudinal chord oriented along the transport direction. Either the load-bearing structure is disposed outside the enclosure and spaced apart from the enclosure or the transport route includes a circular conformation and a ring forming the longitudinal chord.

22 Claims, 3 Drawing Sheets

(51) Int. Cl.

| | |
|---|---|
| ***B65B 7/00*** | (2006.01) |
| ***B65B 55/00*** | (2006.01) |
| ***B67C 3/22*** | (2006.01) |
| *B67C 3/26* | (2006.01) |
| *B67C 7/00* | (2006.01) |
| *B65B 31/02* | (2006.01) |
| *B67B 3/02* | (2006.01) |
| *B67B 3/20* | (2006.01) |

(52) U.S. Cl.
CPC ..... *B67B 2201/08* (2013.01); *B67C 7/0086* (2013.01); *B67C 2003/228* (2013.01); *B67C 2003/2691* (2013.01); *B67C 2003/2694* (2013.01)

(56) References Cited

U.S. PATENT DOCUMENTS

| | | | | |
|---|---|---|---|---|
| 6,026,867 | A | 2/2000 | Klarl | |
| 6,041,834 | A * | 3/2000 | Fujikawa | B65B 39/00 141/172 |
| 6,082,418 | A * | 7/2000 | Naecker et al. | 141/145 |
| 6,185,910 | B1 * | 2/2001 | Achhammer | B67C 7/0073 134/73 |
| 6,230,472 | B1 * | 5/2001 | Stahlecker | 53/426 |
| 6,457,299 | B1 * | 10/2002 | Schwenke et al. | 53/510 |
| 6,679,026 | B1 * | 1/2004 | Cirio | B67B 3/208 53/317 |
| 6,705,062 | B1 * | 3/2004 | Varlet | 53/510 |
| 6,736,172 | B1 * | 5/2004 | Chetaille | B67C 3/10 141/145 |
| 6,830,084 | B1 | 12/2004 | Friede | |
| 7,409,808 | B2 * | 8/2008 | Till | B67C 7/0073 53/136.1 |
| 7,900,422 | B2 * | 3/2011 | Fischer | 53/426 |
| 8,151,544 | B2 * | 4/2012 | Till | B65G 47/847 53/167 |
| 8,621,824 | B2 * | 1/2014 | Mielnik | A61L 2/208 422/28 |
| 8,701,720 | B2 * | 4/2014 | Adriansens | 141/92 |
| 8,776,482 | B2 * | 7/2014 | Drenguis | 53/167 |
| 2003/0226616 | A1 * | 12/2003 | Tawa et al. | 141/144 |
| 2004/0231748 | A1 * | 11/2004 | Friede | 141/144 |
| 2005/0016624 | A1 * | 1/2005 | Till | B67C 7/0086 141/144 |
| 2005/0028487 | A1 * | 2/2005 | Winters et al. | 53/432 |
| 2005/0126118 | A1 * | 6/2005 | Till | B67C 7/0086 53/167 |
| 2006/0059862 | A1 * | 3/2006 | Zanga | 53/319 |
| 2007/0204562 | A1 * | 9/2007 | Till | B67C 7/0073 53/167 |
| 2008/0072535 | A1 * | 3/2008 | Mueller | 53/276 |
| 2008/0295453 | A1 * | 12/2008 | Carlson | E04C 3/29 52/841 |
| 2009/0223169 | A1 * | 9/2009 | Zanini | B67B 3/2033 53/317 |
| 2010/0266467 | A1 | 10/2010 | Laumer et al. | |

FOREIGN PATENT DOCUMENTS

| | | | | |
|---|---|---|---|---|
| DE | 10145803 | | 4/2003 | |
| DE | 10145803 | A1 * | 4/2003 | |
| DE | 10213343 | | 10/2003 | |
| DE | 10213343 | A1 * | 10/2003 | |
| DE | 10341965 | | 4/2005 | |
| DE | 10341965 | A1 * | 4/2005 | |
| DE | 102007047259 | * | 4/2009 | |
| EP | 0436042 | | 7/1991 | |
| EP | 436042 | A1 * | 7/1991 | |
| EP | 1821010 | | 8/2007 | |
| EP | 1821010 | A1 * | 8/2007 | |
| WO | 2007/132339 | | 11/2007 | |
| WO | WO 2007132339 | A1 * | 11/2007 | |
| WO | 2009/009681 | | 1/2009 | |
| WO | WO 2009009681 | A1 * | 1/2009 | A61L 2/082 |

* cited by examiner

DEVICE FOR ASEPTIC OR STERILE TREATMENT OF PACKAGING ELEMENTS

CROSS REFERENCE TO RELATED APPLICATIONS

This application is the national stage application of international application no. PCT/EP2010/005475, filed on Sep. 7, 2010, which claims priority to German application no. 10 2009 054 314.7, filed on Nov. 24, 2009. The contents of the prior applications are incorporated herein by reference.

"Packaging elements" in the sense of the invention are all packaging elements suitable for the packaging of products, including in particular those such as bottles, cans or similar containers for the packaging of liquid products or foods.

"Treatment" in the sense of the invention means in the simplest case the transporting of the packaging elements, but also the cleaning and/or sterilising of the packaging elements, the filling of the packaging elements with the particular filling material or product and the sealing of the filled packaging elements.

"Mechanical connecting means" in the sense of the invention are inter alia screws, nuts, bolts and rivets.

Filling and sealing machines or filling and sealing mechanisms for the aseptic or sterile filling or sealing of packaging elements in the form of bottles or similar containers, for example for the filling of packaging elements with drinks, also with milk products or dairy products, and for subsequent sealing, are known. For aseptic treatment, the packaging elements—at least that sub-area of them which exhibits the packaging element opening—are accommodated in a sterile interior of a sterile housing or of an enclosure and are moved within this sterile interior during the treatment.

Through the interior (sterile space) of the enclosure flows a stream of a sterile gaseous and vaporous medium, preferably a stream of sterile air, moving against the transport direction of the packaging elements or with the transport direction of the packaging elements, and in either case towards a packaging element entry and towards a packaging element exit to prevent ingress of ambient air into the interior of the enclosure. The more trouble-free the flow of gaseous and/or vaporous sterile medium through the interior of the enclosure, the greater is the safety from contamination or recontamination of the sterile interior by bacteria from the environment.

It is a requirement for the interior of the enclosure to be designed as small as possible and free from gaps, corners, edges, projections etc., with the result that the enclosures of known devices are usually complex structures by virtue of these demands alone. These are usually executed as a large-volume or large-sized self-supporting welded structure which after welding require [sic] straightening and/or metal-cutting machining at least at joining and connecting regions. This is the only way to achieve the dimensional accuracy that is necessary for the particular enclosure or its sub-sections or elements when the enclosure consists of a section or sub-area that is moved with the conveyor of the device and of a stationary section or sub-area that is not moved with the conveyor and when seals are provided between these sections or sub-areas. The said straightening and re-machining of the large-sized welded structures necessitates corresponding production machines of an appropriate magnitude. The large-sized welded structures of known enclosures are also associated with high costs and tolerance problems, even for positionally accurate parts, because large-sized structures and especially large-sized welded structures make it very difficult to achieve necessary tolerances of dimension, position and location.

Regarding hygienic design, known enclosures also have considerable disadvantages because the self-supporting configuration of these enclosures or of their sub-areas often prevents them, and in particular their interior surfaces, from being designed strictly according to hygienic design criteria, so that major compromises have to be accepted in this regard in any event. Thus for example with known enclosures the flow of the sterile vaporous and/or gaseous medium, for example sterile air, in the interior of the enclosure is impeded in many regions, inter alia by force-absorbing and/or moment-absorbing components of the self-supporting enclosure which protrude into the interior of the enclosure.

Enclosures in the form of complete bolted-together and self-supporting structures are also known. With such enclosures too, disadvantages relating particularly to the hygienic design of the interior, and of the inside surfaces of the enclosure which bound this interior, are unavoidable.

It is the object of the invention to provide a device which avoids the afore-mentioned disadvantages and which in regard to hygienic requirements can be optimally designed on the inside of its interior and yet independently of static and/or dynamic demands relating to the absorption of forces and moments.

The particularity of the invention consists in the fact that at least one sub-section of the enclosure is designed in such a way that at this sub-section the loadbearing or force-absorbing and moment-absorbing function is separated from the function of sealing the interior of the enclosure from the environment, i.e. the enclosure or the particular sub-section of this enclosure consists of an outer loadbearing or force-absorbing and moment-absorbing structure and of a wall structure which is free from loads or from forces and moments and which is held, preferably suspended, on the loadbearing structure. The loadbearing structure is realised preferably by connecting the individual components or functional elements which form this structure and/or by connecting the loadbearing structure to a device mount or frame by means of mechanical connecting means, for example bolts and/or screws, while the wall structure that is formed for example of metal panels or steel panels is fabricated from wall elements preferably by welding and again preferably by butt-welding or by forming welds that are seal-tight but not under load, preferably square butt welds, and inserted into the outer loadbearing structure and attached to it.

By connecting the individual components of the loadbearing structure to each other and to the device mount or device frame using mechanical connecting means it is possible to inexpensively prefabricate these individual components as relatively small and dimensionally accurate components, i.e. with close tolerances, and to re-machine them, for example by chip removal, at the connecting sections or connecting surfaces so that the loadbearing structure can also be realised with high dimensional accuracy and with a reduced amount of fabrication and assembly. The individual components or wall sections that form the wall structure are inserted into the fully assembled loadbearing structure that determines the dimensional stability of the enclosure or of the affected sub-section of the enclosure, and are connected to each other and to the loadbearing structure and/or to the machine frame by the seal-tight welds.

Edges or ribs are preferably prepared on the loadbearing structure and/or device mount, to which said edges or ribs the wall elements or panels forming the wall structure are then welded with the seal-tight welds, preferably with the square butt welds.

Because the welds between both the individual components of the wall structure and between the wall structure and the loadbearing structure and/or device mount have a sealing function only and are not required to transmit forces or moments, they or their weld geometry can be greatly simplified despite a complex and solid configuration of the loadbearing structure, and executed so that the heat input into the enclosure during welding is significantly reduced overall. This is also greatly assisted by the fact that the welds are preferably executed as square butt welds and are formed along components which preferably each exhibit the same material thickness and along the wall elements or wall panels forming the wall structure as well as along welding edges or welding ribs that are prepared on the loadbearing structure and/or device mount.

The need to machine large-sized welded structures is eliminated even though the loadbearing structure and/or its individual components exhibit connection faces which require positionally accurate attachment.

The wall structure and its wall elements or individual elements can be separately manufactured simplified as panel elements or segments and/or in an easy-to-handle format, for example by laser cutting and bending. The individual components of the wall structure are then merely tightly interconnected by the welds which guarantee seal-tightness. As a result, the surface quality which is essential particularly from a hygienic standpoint not least on the interior surface of the enclosure is significantly improved and is achievable with a greatly reduced effort.

Because the loadbearing structure is outside the enclosure and preferably spaced apart from the wall structure, the floor of the enclosure in particular is totally free of projections, edges etc. which not only impede the flow of the sterile gaseous and/or vaporous medium but also form regions which can only be accessed with difficulty by a liquid and/or gaseous and/or vaporous cleaning and/or sterilisation medium with which the enclosure is for example periodically cleaned and/or sterilised.

Moreover the absence of any protrusions, edges etc. on the floor region of the enclosure also guarantees the unimpeded runoff of fluids of any kind and the floor region of the enclosure can be viewed at any time and so visually examined for cleanness.

In the case of a circular configuration of the transport route for the packaging elements, i.e. in particular when the conveyor is configured as a rotor which circulates about a vertical machine axis, the enclosure is executed as an annular channel having a constant or at least mostly constant cross-section, so permitting the unobstructed passage of the sterile gaseous and/or vaporous medium, for example of the sterile air.

The loadbearing structure and the wall structure are manufactured with the use of corrosion-resistant steel or stainless steel.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

The invention is explained in detail below through the use of an embodiment example with reference to the figures.

Figure 4:
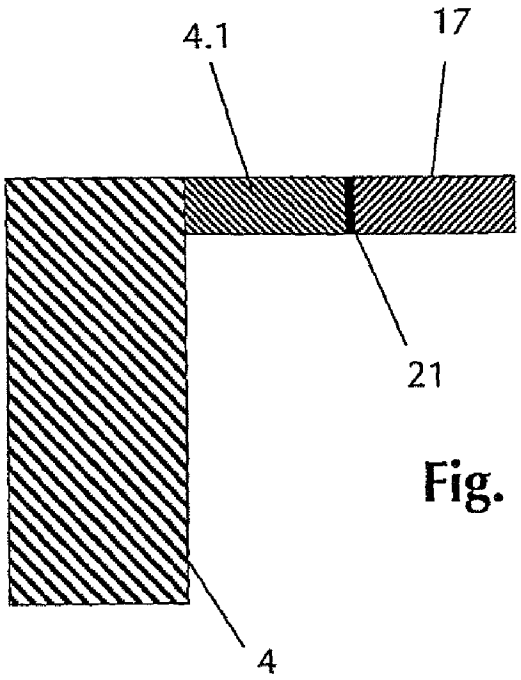
Figure 3:
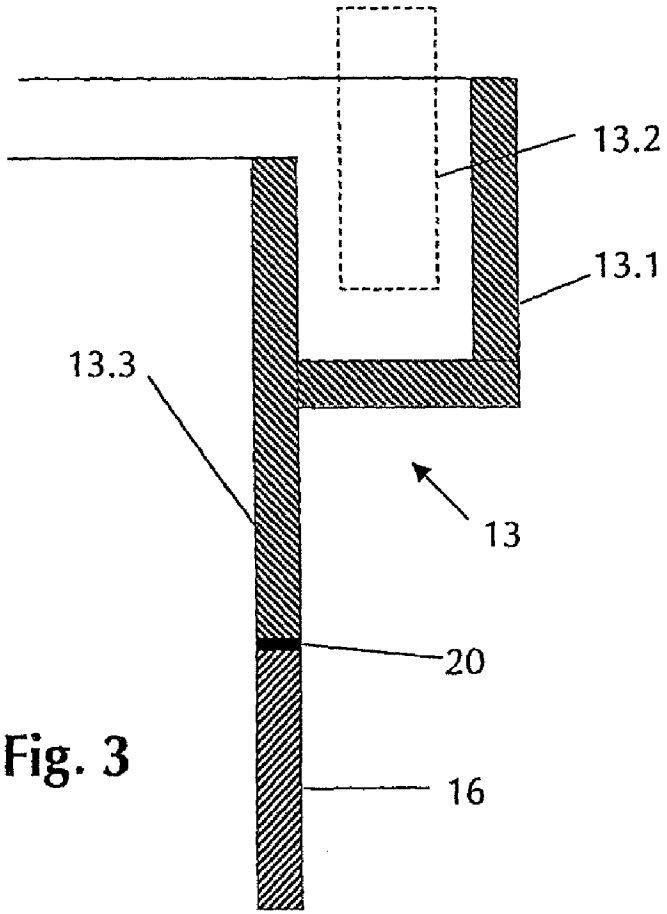

FIGS. 3 and 4 each show enlarged partial views of welded joints between the loadbearing structure that absorbs the forces and moments and the enclosure's wall structure that is free or at least essentially free from loads and/or of forces and moments.

In the figures, '1' is a container treatment machine or container treatment device in the form of a rotary filling machine for the aseptic filling of bottles 2 or other containers in a sterile interior 3 with a liquid filling material or drink, for example in the form of a milk or dairy product. Treatment machine 1 comprises inter alia a rotor 5 which is mounted rotatably about a vertical machine axis MA on a machine frame 4 and which can be driven to rotate about said machine axis MA and on whose disc-like peripheral region 5.1 is provided a plurality of treatment or filling positions 6 of which each consists of a filling element 7 attached to the peripheral region 5.1 and of a container carrier 8 from which the respective bottle 2 is held suspended by a mouth flange formed below the bottle mouth 2.1 and in such a way that it is located with its bottle mouth 2.1 under a discharge opening of filling element 7. The filling of respective bottle 2 is effected in the manner known to the person skilled in the art by the controlled opening and closing of a liquid valve provided in filling element 7 so that the liquid filling material flows into respective bottle 2 through the bottle mouth 2.1 when the liquid valve is open.

During the entire treatment period, i.e. at least during the entire filling process, bottles 2 are continuously accommodated within the sterile interior 3 of an enclosure 9 which (interior) is formed by an enclosure 9 [sic] and through which passes or flows for example a sterilising gaseous and/or vaporous medium, for example sterile air, said enclosure 9 bounding interior 3 from surrounding space 10. The latter is formed in the depicted embodiment by interior 10 of an outer enclosure 11 in which are arranged treatment machine 1 and preferably a subsequent treatment machine (not shown) which is configured as a sealing machine.

Enclosure 9 is adapted to the size of bottles 2 that are to be processed with treatment machine 1 so that its interior 3 exhibits a volume which is as small as possible but that bottles 2 all find room in interior 3 and also that inside enclosure 9 there is a partial space not occupied by bottles 2 large enough to ensure that the vaporous and/or gaseous sterile medium can flow through interior 3 unobstructed.

In the depicted embodiment, enclosure 9 consists mainly of an enclosure section 9.1 lying inward relative to machine axis MA and formed on rotor 5 and rotating with rotor 5, and of an enclosure section 9.2 lying radially outward relative to machine axis MA on the machine frame side, i.e. not rotating with rotor 5. In the depicted embodiment, enclosure section 9.1 is formed by disc-like rotor section 5.1 and by annular wall 12 which is tightly connected to rotor section 5.1, projects down away from this rotor section 5.1 and concentrically encircles machine axis MA. Between the two enclosure sections 9.1 and 9.2 are provided two seals 13, 14, each configured as siphon seals and consisting respectively of a ring 13.1 and 14.1 concentrically encircling machine axis MA with machine frame 4 and manufactured from a U-section which is open at the top and into which engages a ring 13.2 and 14.2 provided respectively on rotor section 5.1 and on the lower edge of wall 12 and concentrically encircling machine axis MA. During operation, the U-sections of rings 13.1 and 14.1 are each charged with a sterile liquid medium to form siphon seals 13 and 14.

The particularity of the treatment machine and of its enclosure 9 consists in the fact that the outer enclosure section 9.2 is subdivided into an outer loadbearing structure that absorbs forces and moments and a wall structure that is kept free or largely free from forces and moments, that the connections within the loadbearing structure as well as the connections of this structure with machine frame 4 are made using mechanical connection means, and that to achieve the required accuracy and dimensional stability the elements of the loadbearing structure are machined on their connecting faces or connecting regions, whereas connections between the elements or individual components of the wall structure are entirely or almost entirely relieved of forces and are for example executed at least in part as simple but seal-tight welded joints that are preferably welded joints made by butt welding or square butt welds.

In the depicted embodiment the loadbearing structure of outer enclosure section 9.2 consists of a plurality of supports 15 distributed at equal angular distances about machine axis MA and each attached to machine frame 4 by its lower end or by a support section 15.1 there located. Ring 13.1 of siphon seal 13 is attached at the upper end of support 15 formed by a support section 15.2 so that supports 15 mounted on machine frame 4 form a very strong grid-like or cage-like support structure together with common ring 13.1. As FIG. 1 in particular shows, supports 15 are designed so that they surround enclosure section 9.2 at a distance, both in the region of the underside of enclosure 9 as well as in a region concentrically encircling machine axis MA, lying radially outward relative to machine axis MA. In the depicted embodiment, this is achieved by orienting support section 15.1 radially or essentially radially to machine axis MA, support section 15.2 parallel or essentially parallel to machine axis MA and an interposed support section 15.3 at an angle to support sections 15.1 and 15.2.

In the depicted embodiment, the wall structure of enclosure section 9.2 consists inter alia of two wall sections 16 and 17 each made from stainless steel sheet, of which wall section 16 concentrically encircles machine axis MA in the manner of a hollow cylinder and forms the radially outward boundary of interior 3. The other wall section 17 is made in the manner of a tapered ring also concentrically encircling machine axis MA and forms the floor of interior 3 which (floor) is executed sloping radially inwards relative to machine axis MA. The two wall elements 16 and 17 are interconnected at 18 by a connection that is relieved or largely relieved of forces and moments, for example by a weld seam, preferably by a square butt weld.

It is of course also possible to provide wall sections 16 and/or 17 as components which have been manufactured by bending methods. The annular channel in which containers 2 are guided or transported is created by welding segments to one another. In the case of one embodiment it is therefore possible for the annular channel to represent a channel with many corners.

It goes without saying that wall elements 16 and 17 consist in their turn of a plurality of individual elements which are connected with one another tightly to the respective wall section 16 and 17 with force-free and moment-free tight connections, in particular welded joints and preferably square butt welds.

Figure 2:
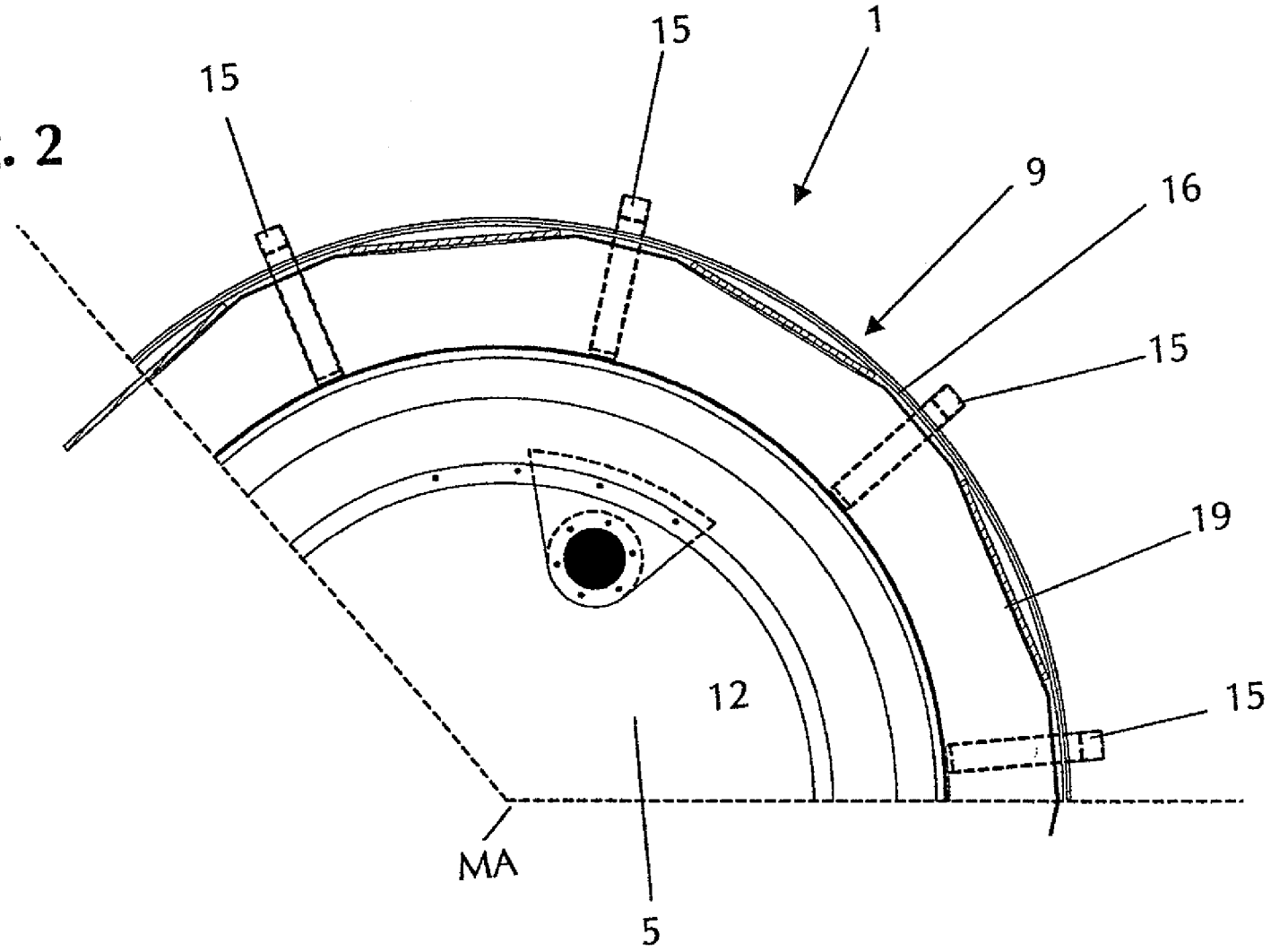
FIG. 2 shows a partial plan view of the machine depicted in FIG. 1.

In the depicted embodiment, a plurality of inspection windows each closed by a pane 19 made from a transparent material, for example glass or a transparent plastic, is provided in wall section 16. As FIG. 2 also shows, wall section 16 is polygonally configured, having sub-sections which run in a straight line, extend between two supports 15 and on which are provided the windows closed by panes 19.

To connect wall sections 16 and 17 to the loadbearing structure, i.e. to ring 13.1 and machine frame 4, there are provided and/or prepared on ring 13.1 an annular welding rib 13.3 projecting away over the underside of this ring and concentrically encircling machine axis MA, and on machine frame 4 an annular welding rib 4.1 projecting away radially outward relative to machine axis MA which it concentrically encircles. Welding ribs 13.3 and 4.1 each possess a material thickness which is equal or approximately equal to the material thickness of wall elements 16 and 17. At welding rib 13.3, wall element 16 is connected to ring 13.1 and so to the loadbearing structure of enclosure section 9.2 in the form also depicted in FIG. 3 by butt-welding, i.e. with a square butt weld 20. Similarly, wall element 17 is connected by its inward edge to the loadbearing structure and/or machine frame 4 via welding rib 4.1 by butt-welding, i.e. with a square butt weld 21.

Not only does the loadbearing structure which is arranged outside enclosure 9, i.e. surrounding this enclosure below and radially outside it, isolate the connections of wall sections 16 and 17 or their elements to both one another and to the loadbearing structure and machine frame from forces and loads, the arrangement of the loadbearing structure outside enclosure 9 also achieves smooth surfaces inside this enclosure, in particular avoiding inter alia regions inside interior 3 which are angled and/or inaccessible and/or project into interior 3 and which obstruct the flow inside interior 3, are hard to clean and/or sterilise and could easily lead to contamination.

Figure 1:
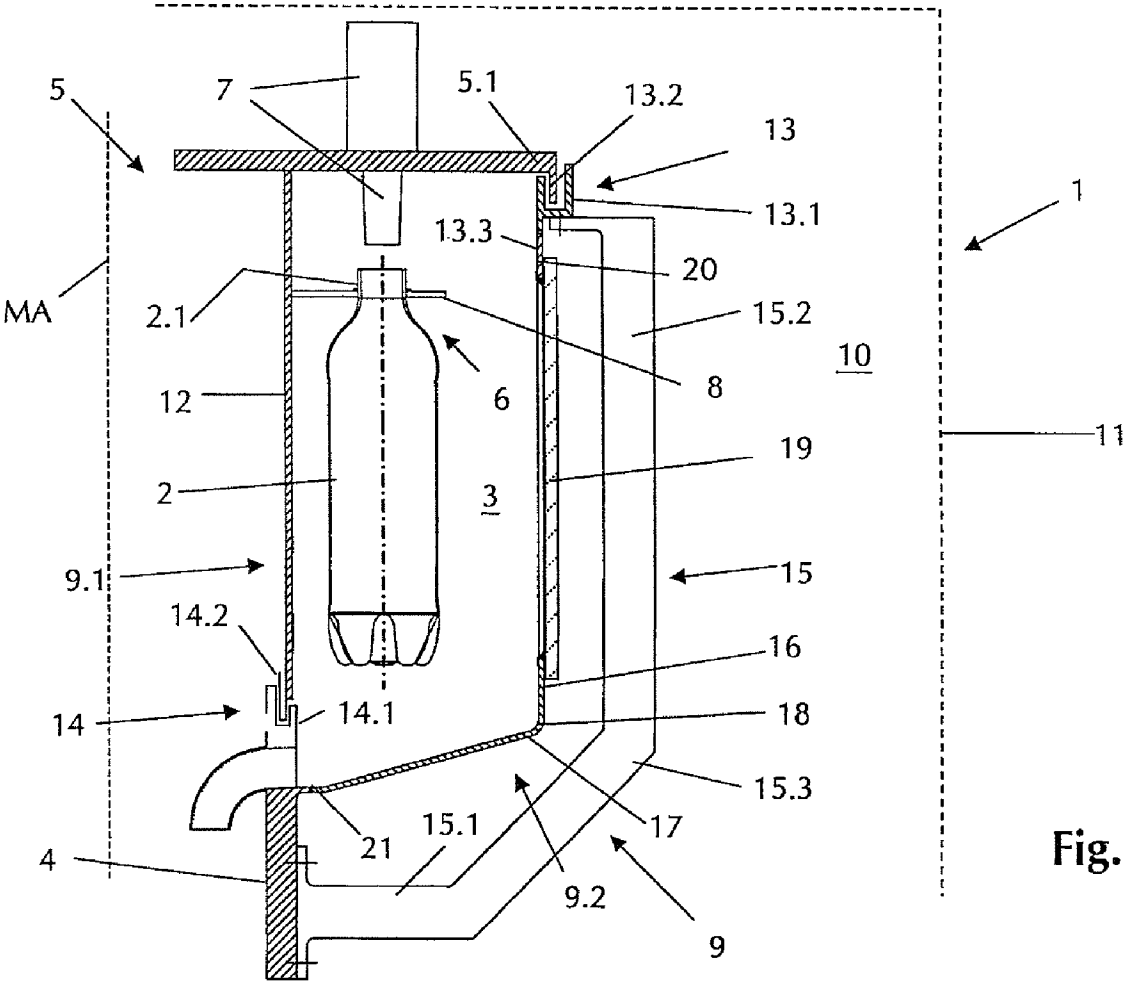
FIG. 1 shows a partial section through a rotor and through adjacent parts of the machine frame of a machine or device for treating containers in a sterile interior constituted by an enclosure, here in the form of a filling machine for the aseptic filling of the containers.

The floor of interior 3 in particular is also completely smooth and equally free from elements such as edges, structural frame sections etc. protruding into interior 3. The floor is also devoid of outlets for liquids or for cleaning or sterilising fluids which accumulate during the treatment of bottles 2 or are used during the cleaning and/or sterilisation of treatment machine 1. Inlets and outlets are also [sic] disposed on the loadbearing structure and/or on machine frame 4, as shown in FIG. 1 for outlet 22.

A further essential advantage of the described configuration of enclosure 9 is that the latter, and in particular enclosure section 9.2 as well, can be manufactured with great dimensional accuracy and with great accuracy of arrangement and orientation by the fact that the outer loadbearing structure essentially consisting of ring 13.1 and supports 15 can be fabricated using mechanical connection means while very precisely achieving the necessary dimensional accuracy for the individual components and for the joining and connecting faces themselves, and that this dimensional stability of enclosure 9 that is due to the loadbearing structure is not altered when wall sections 16 and 17 are welded on.

The invention has been described hereinbefore by reference to one embodiment. It goes without saying that numerous variations as well as modifications are possible without departing from the inventive concept underlying the invention.

It has been previously assumed for example that treatment machine 1 is a filling machine. Other configurations of the treatment machine, for example as a machine for sealing filled containers or for cleaning and/or sterilising containers etc., can also be constructed in the same or similar manner as described above in regard to enclosure 9 which bounds sterile interior 3.

It is also possible to provide an enclosure between two machines or units in transport direction of containers or bottles 2 which forms a sterile space and which is also configured such that at least one sub-area of this enclosure consists of an outer loadbearing structure to absorb forces and moments and of a wall structure which bounds the sterile interior of the enclosure from the environment, is held on the loadbearing structure and is isolated from loads and/or forces and moments.

It has been previously assumed that the containers and/or bottles 2 are each fully accommodated in enclosure 9. Embodiments are possible however in which, to reduce the volume of the sterile interior for example, the containers are only accommodated by their container section or container neck that exhibits the container mouth.

REFERENCE LIST

1 Container treatment machine
2 Container or bottle
2.1 Bottle mouth
3 Sterile interior
4 Machine frame
4.1 Welding ring or annular weld edge on the machine frame
5 Rotor
5.1 Disc-like rotor section
6 Treatment station
7 Filling element
8 Container carrier
9 Enclosure
9.1, 9.2 Enclosure section
10 Space
11 Outer enclosure
12 Wall
13, 14 Siphon seal
13.1, 14.1 Ring
13.2, 14.2 Ring
13.3 Welding ring or weld edge
15 Support
15.1, 15.3 Support section
16, 17 Wall element
18 Weld seam or welded joint
19 Pane
20, 21 Weld seam or welded joint
22 Outlet
MA Machine axis

The invention claimed is:

1. An apparatus for treating a packaging element having a sub-area that includes a packaging element opening, said apparatus comprising: an enclosure, a conveyor forming a transport route along which said packaging element is moved along a transport direction with said sub-area that includes said packaging element opening being disposed inside a sterile interior defined by said enclosure, said enclosure including an outer load-bearing structure having load-bearing elements, and a wall structure held in said load-bearing structure and isolated by said load bearing structure from loads, wherein said load-bearing structure includes supports oriented transversely to said transport direction, said supports being connected to a longitudinal chord oriented along said transport direction to form said load-bearing structure, wherein a first subsection of said enclosure is provided on and moved with said conveyor, and wherein a second sub-section of said enclosure is provided on a device frame and not moved with said conveyor, and wherein said load-bearing structure is disposed outside said enclosure and spaced apart from said enclosure.

2. The apparatus of claim 1, further comprising a seal disposed at an interface between said first and second sub-sections, said seal being provided outside said wall structure.

3. The apparatus of claim 1, further comprising a labyrinth seal disposed at an interface between said first and second sub-sections, said labyrinth seal being provided outside said wall structure.

4. The apparatus of claim 1, further comprising a siphon seal disposed at an interface between said first and second sub-sections, said siphon seal being provided outside said wall structure.

5. The apparatus of claim 1, further comprising a seal disposed at an interface between said first and second sub-sections, said seal being provided outside said wall structure on said load-bearing structure.

6. The apparatus of claim 1, further comprising a seal disposed at an interface between said first and second sub-sections, said seal being provided outside said wall structure on said device frame.

7. The apparatus of claim 1, wherein said load-bearing elements are connected to each other and to said device frame by mechanical connections.

8. The apparatus of claim 1, wherein said load-bearing elements are connected to each other and to said device frame by at least one of a screw and a bolt.

9. The apparatus of claim 1, wherein said load-bearing elements are connected to each other and to said device frame by a rivet.

10. The apparatus of claim 1, wherein at least one of wall sections and wall elements forming said wall structure are welded to said load-bearing structure.

11. The apparatus of claim 1, wherein said wall structure forms a smooth inner surface of said enclosure.

12. The apparatus of claim 1, wherein said load-bearing structure comprises a cage formed by said load-bearing elements.

13. The apparatus of claim 12, wherein said transport route includes a circular conformation and a ring forming said longitudinal chord.

14. The apparatus of claim 13, wherein said longitudinal chord forms part of a seal.

15. The apparatus of claim 14, wherein said longitudinal chord is formed by a U-shaped section open at a top thereof and extending along said transport direction of said conveyor, and connected by mechanical connectors to said load-bearing elements.

16. The apparatus of claim 1, said apparatus further comprising a filling device for aseptic filling of said packaging elements with a filling material.

17. The apparatus of claim 1, said apparatus further comprising a cleaning device for cleaning said packaging elements.

18. The apparatus of claim 1, said apparatus further comprising a sealing device for sealing filled packaging elements.

19. The apparatus of claim 1, wherein said transport route provides transport for said packaging element between two machines, one following the other in a transport direction.

20. An apparatus for treating a packaging element having a sub-area that includes a packaging element opening, said apparatus comprising: an enclosure, a conveyor forming a transport route along which said packaging element is moved along a transport direction with said sub-area that includes said packaging element opening being disposed inside a sterile interior defined by said enclosure, said enclosure including an outer load-bearing structure having load-bearing elements, and a wall structure held in said load-bearing structure and isolated by said load bearing structure from loads, wherein said load-bearing structure includes supports oriented transversely to said transport direction, said supports being connected to a longitudinal chord oriented along said transport direction to form said load-bearing structure, wherein a first subsection of said enclosure is provided on and moved with said conveyor, and wherein a second sub-section of said enclosure is provided on a device frame and not moved with said conveyor, wherein said load-bearing structure comprises a cage formed by said load-bearing elements, and wherein said transport route includes a circular conformation and a ring forming said longitudinal chord.

21. The apparatus of claim 20, wherein said longitudinal chord forms part of a seal.

22. The apparatus of claim 21, wherein said longitudinal chord is formed by a U-shaped section open at a top thereof and extending along said transport direction of said conveyor, and connected by mechanical connectors to said load-bearing elements.

* * * * *